United States Patent [19]

Fujikawa et al.

[11] Patent Number: 4,531,487

[45] Date of Patent: Jul. 30, 1985

[54] ENGINE STOPPING DEVICE

[75] Inventors: Tetsuzo Fujikawa, Kobe; Shinichi Tamba, Kakogawa; Hitomi Miyake, Kobe, all of Japan

[73] Assignee: Kawasaki Jukogyo Kabushiki Kaisha, Japan

[21] Appl. No.: 568,149

[22] Filed: Jan. 4, 1984

[51] Int. Cl.[3] ..... F02B 77/08

[52] U.S. Cl. ..... 123/198 DC; 123/41.15; 123/41.65; 123/198 D

[58] Field of Search ..... 123/198 DC, 198 D, 41.15, 123/41.65, 392, 334, 335

[56] References Cited

U.S. PATENT DOCUMENTS

| | | | |
|---|---|---|---|
| 2,791,207 | 5/1957 | Rayniak | 123/198 DC |
| 4,022,180 | 5/1977 | Bosma | 123/198 DC |
| 4,058,105 | 11/1977 | Schellin et al. | 123/198 DC |
| 4,236,494 | 12/1980 | Fairchild | 123/198 DC |
| 4,363,298 | 12/1982 | Kuhn | 123/198 DC |

OTHER PUBLICATIONS

"Service and Repair Instructions", Briggs & Stratton Corporation, Jul. 1981, pp. 8 and 14.

*Primary Examiner*—Ira S. Lazarus

*Attorney, Agent, or Firm*—Leydig, Voit, Osann, Mayer and Holt, Ltd.

[57] ABSTRACT

An engine stopping device for rendering an internal combustion engine of a spark ignition type by grounding an ignition circuit includes a contact section for achieving grounding which is exposed to air flow passing through an engine cooling air passage, to clean off dry grass or other foreign materials from the contact section.

7 Claims, 3 Drawing Figures

ENGINE STOPPING DEVICE

BACKGROUND OF THE INVENTION

This invention relates to an engine stopping device of an internal combustion engine of a spark ignition type which is operative to cease the operation of the engine by grounding either a primary wire or a secondary wire of a step-up transformer for ignition.

Generally, an engine of a small size is equipped with an engine stopping device of the aforesaid type in which a contact section for achieving grounding is located outside the engine. For example, a service manual entitled "Service and Repair Instructions" issued in July 1981 by BRIGGS & STRATTON shows in FIG. 27 on page 8 an engine stopping device of the aforesaid construction.

Some disadvantages are associated with the engine stopping device of the aforesaid construction. Assume that an engine of the aforesaid type is used with a lawn mower. Since the contact section for achieving grounding is located outside the engine, dust or dry grass might collect in the vicinity of the contact portion during operation of the lawn mower. In such situations, an insufficient maintenance for the engine is possible to cause a contact trouble.

SUMMARY OF THE INVENTION

This invention has been developed for the purpose of obviating the aforesaid disadvantage of the prior art. Accordingly, the invention has as its object the provision of an engine stopping device of an internal combustion engine of the spark ignition type capable of avoiding contact trouble due to dust or dry grass by locating the contact section for grounding in the passage of intense air flow for engine cooling.

The outstanding characteristic of the invention is that the contact section for achieving grounding is located in an engine cooling air passage.

Other and further objects, features and advantages of the invention will appear more fully from the following description.

DETAILED DESCRIPTION OF THE PREFERRED EMBODIMENT

A preferred embodiment of the invention will now be described by referring to the accompanying drawings.

Figure 1:
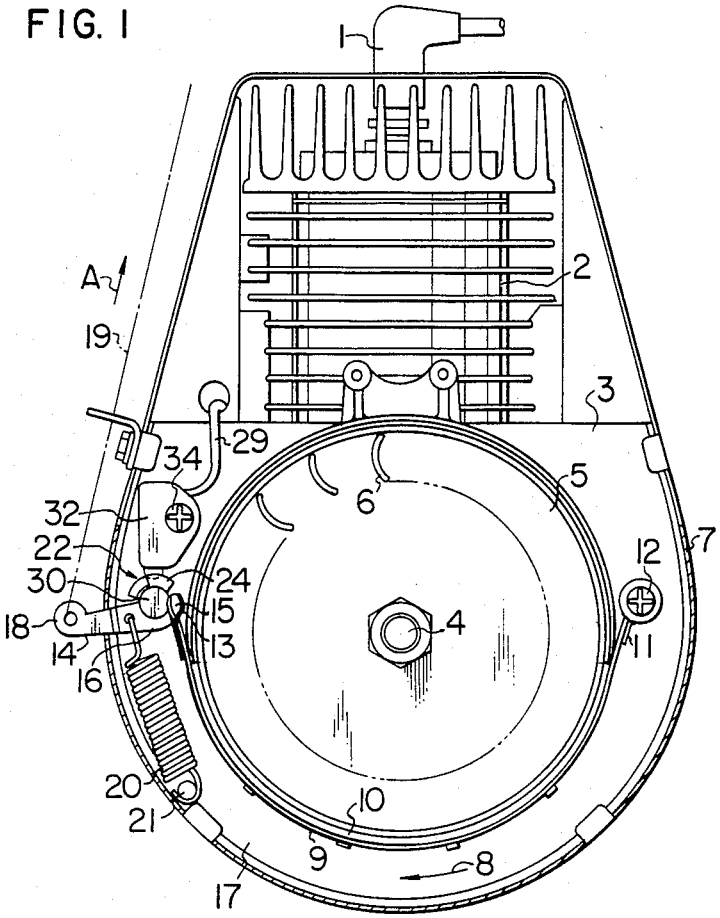
FIG. 1 is a front view, with certain parts being cut out, of the engine stopping device of an internal combustion engine of a spark ignition type comprising one embodiment of the invention.

Referring to FIG. 1, there is shown an engine comprising an ignition plug 1, a cylinder block 2, a crankcase 3, a crankshaft 4 and a flywheel 5 located at an end portion of the crankshaft 4 extending from the crankcase 3. The flywheel 5 has a cooling fan 6 integrally formed at an outer peripheral edge portion thereof for discharging a cooling air current 8 from its outer periphery which is guided by an air guide plate 7 radially spaced from the flywheel to flow into the cylinder block 2. Located along the outer peripheral surface of the flywheel 5 is a brake band 9 provided with a lining 10 which is supported at one end portion 11 thereof by a band support member 12 of the crankcase 3 and at the opposite end portion 13 by a projection 15 of an actuating arm 14 of electrically conducting material. A base 16 of the actuating arm 14 having the projection 15 is located in an engine cooling air passage 17, and a forward end portion 18 thereof extends outwardly through the air guide plate 7 and is connected to a brake release wire 19. The actuating arm 14 which is pivotably supported by a pin 30 is biased by a braking spring 20 connected at its one end to a pin 21 in a manner to tension the brake band 9. The numeral 22 designates a contact section for achieving grounding which is located in the engine cooling air passage 17.

Figure 2:
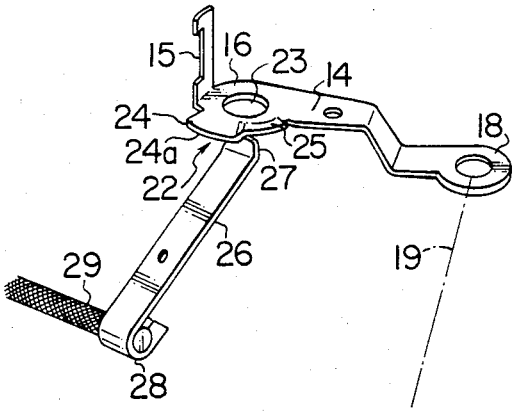
FIG. 2 is a perspective view, on an enlarged scale, of the contact section for achieving grounding.

FIG. 2 shows in detail the contact section 22 for achieving grounding. The base 16 of the actuating arm 14 is formed with an opening 23 and a contact member 24. A portion of an outer peripheral edge of the actuating arm 14 which is close to the opening 23 and located adjacent the contact member 24 is bent to provide a stepped portion 25 serving as a means to prevent accumulation of dust or a dust preventing portion. A contact 26 of electrically conductive material is formed at one end portion thereof with a contact member 27 brought into and out of contact with the contact member 24 and connected at the opposite end portion 28 to a grounding wire 29 connected to a primary wire or a secondary wire, not shown, of step-up transformer of an ignition circuit.

Figure 3:
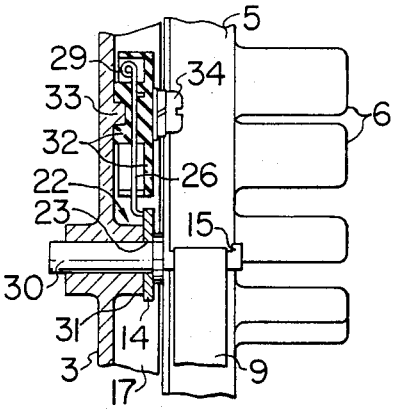
FIG. 3 is a schematic view of the actuating arm and the contact section, showing their structural relationship.

Referring to FIG. 3, the actuating arm 14 is pivotably supported by the support pin 30 extending through the opening 23 at a bearing portion 31 of the crankcase 3. The contact 26 is supported by an insulating member 32 which in turn is fitted to a positioning portion 33 of the crankcase 3 and secured thereto by a threaded member 34.

In operation, at engine startup, manipulation of a steering handle pulls the brake release wire 19 in the direction of an arrow A as shown in FIG. 1 against the biasing force of the braking spring 20, to allow the actuating arm 14 to move in pivotal movement about the support pin 30 in a clockwise direction. As a result, the brake band 9 is loosened and the braking force exerted on the flywheel 5 is released, while the contact member 24 of the actuating arm 14 shown in FIG. 2 is released from contact with the contact member 27 of the contact 26, to bring the grounding wire 29 to a non-grounding condition. At this time, the dust preventing member 25 of the actuating arm 14 is brought to a spaced juxtaposed relation to the contact member 27 of the contact 26 with a predetermined clearance therebetween, to prevent the contact member 27 from becoming dusty.

Rotation of the cooling fan 6 shown in FIG. 1 as a result of engine startup produces the engine cooling air current 8 in the engine cooling air passage 17 which cools the cylinder block 2 and is led to outside of the air guide plate 7. As the force exerted to pull the brake release wire 19 in the direction of the arrow A is released during engine operation, the actuating arm 14 is moved in pivotal movement by the biasing force of the braking spring 20 in a counterclockwise direction in FIG. 1. This brings the contact member 24 of the actuating arm 14 into contact with the contact member 26 of the contact 26, so that the grounding wire 29 is connected with the bearing portion 31 (see FIG. 3) of the crankcase 3 of metal material through the actuating arm 14, to thereby ground the primary or secondary wire of the ignition circuit, not shown, to put an end to the sparking of the ignition plug. At the same time, the end portion 13 of the brake band 9 is pulled in FIG. 1 to force the lining 10 against the outer peripheral surface of the flywheel 5, to thereby quickly render the engine inoperative.

Meanwhile, the two contact members 24 and 27 shown in FIG. 2 constituting the contact section 22 for achieving grounding are exposed, during engine operation, to the engine cooling air current 8 from the fan 6 in the engine cooling air passage 17 as shown in FIG. 1. Thus, no fine dust or dry grass happens to stagnate at the contact section 22, and contact trouble may be avoided.

The contact section 22 for achieving grounding has been shown and described as being moved between open and closed positions in conjunction with the movement of the brake band 9. However, this is not restrictive, and the contact section 22 may be moved between the open and closed positions independently of the operation of the brake band 9.

From the foregoing description, it will be appreciated that the engine stopping device according to the invention can achieve, by virtue of the arrangement that the contact section thereof for achieving grounding is located in the engine cooling air passage, the effect of avoiding stagnation of dust or dry grass during engine operation, and of cleaning up dust or dry grass which has clung to the contact section during engine shutdown, at engine restart.

Having described a specific embodiment of the engine stopping device in conformity with the invention, it is believed obvious that modification and variation of the invention is possible is light of the above teachings.

What is claimed is:

1. An engine stopping device comprising a contact section for achieving grounding of an ignition circuit to render the engine inoperative, wherein the improvement resides in that:

said contact section for achieving grounding of the ignition circuit is located in an engine cooling air passage defined by a peripheral edge portion of a flywheel and an air guide plate radially spaced from said flywheel.

2. An engine stopping device as claimed in claim 1, wherein said contact section for achieving grounding is movable between an open position and a closed position in conjunction with the operation of a brake band for rendering the engine inoperative.

3. An engine stopping device as claimed in claim 1 wherein said peripheral edge portion of said flywheel is provided with a fan.

4. An engine stopping device according to claim 1 wherein said contact section is provided with a means to prevent accumulation of dust.

5. An engine stopping device as claimed in claim 2 wherein said contact section comprises a pivotally supported actuating arm of an electrically conductive material and a grounded contact member.

6. An engine stopping device as claimed in claim 5 wherein grounding is achieved when said pivotally supported actuating arm contacts said grounded contact member in a closed position.

7. An engine stopping device as claimed in claim 6 wherein said brake band is operatively secured to said pivotally supported actuating arm and contacts a peripheral edge portion of a flywheel when said contact section is in a closed position.

* * * * *